RAILWAY ANTINOISE POLLUTION ARRANGEMENTS

SUBJECT OF THE INVENTION

This invention relates to an antinoise polluting railway apparatus and more particularly to unique sound energy absorbing rail arrangements for reducing wheel squealing noises emanating from gripping types of railroad car retarders or at curve track sections and tight gauge location.

BACKGROUND OF THE INVENTION

In a gravity type of railroad classification yard, it is common practice to utilize wheel gripping car retarders at both master and group locations to control the leaving speeds of humped railway cars or vehicles. In addition, it is also becoming increasingly popular to employ a car retarder at the exit end of each of the class tracks of the yard to stop the oncoming railway cars as they are processed into the respective classification tracks. The car retarders frictionally engage or grip the opposite sides of the car wheels to slow down the moving vehicles as they pass through the master and group locations and to stop the railway vehicles at the exit ends of the class tracks. In many cases the frictional gripping action between the brake shoes and wheels causes extremely loud and piercing squealing noises to permeate the immediate surrounding residential area bordering the yard. These high pitched screeching sounds not only are irritating or annoying to residents of the area but also are painful and injurious to working personnel in the yard. In some cases, a partial or total loss of hearing may result when yard employees are exposed to the retarder noises for extended periods of time. It has been found that long-term exposure to sounds above a critical level adversely affects workmen or supervisory personnel who work in the area of the car retarders. These acute and detrimental sound waves are produced by the stick-slip or rubbing action which takes place between the sides of the wheels of the moving car and the engaging surfaces of the brake shoes of the actuated car retarder. In actual operation, it has been found that the most troublesome pitch or frequency range of the retarder generated sound waves lies between 2,000 to 4,000 hertz. Further, the loudness or amplitude level of the noises may reach a 130 decibels db(A) or more at a distance of 8 feet or less from the car retarder. Otolarynologists, audiologists and other qualified specialists have found that human beings experience discomfort and pain when exposed to noise levels of 120 db(A) or more and that repeated exposure to such high levels of noise can eventually result in hearing losses. Recently there have been numerous proposals and schemes to eliminate or at least reduce the noise level in order to comply with the regulations of the Occupational Safety and Hazard Act and the noise pollution ordinances of the given locale. However, each of these previous attempts was either prohibitively expensive or mechanically unsound and, therefore, did not meet with industry-wide acceptance. The proposition of replacing steel brake shoes with ductile iron appeared plausible but proved uneconomical since ductile iron shoes wear four times as fast as steel. Hence, a railroad car retarder equipped with ductile iron shoes normally requires four times as many shoe replacements as an all steel retarder. Obviously, a car retarder fitted with ductile iron shoes needs a greater number of adjustments and requires more periods of maintenance than a car retarder equipped with steel shoes. The use of lubricants, such as, oils and mixtures of other unctuous liquids, that are sprayed or otherwise applied to the contacting surfaces of the brake shoes and wheels for eliminating wheel squealing or screeching noises is also possessed of several shortcomings. The utilization of lubricants not only materially decreases the effective braking length of the car retarder but also dramatically increases the initial purchase price as well as the subsequent maintenance cost of the overall car retarder. A further deleterious effect of employing lubricants in combating the noise pollution problem is the unctuous ground covering in the immediate area of the car retarder as well as the oil dropping pollution caused throughout the classification yard. A further method in attempting to resolve the noise pollution problem in classification yards has been the erection of sound barriers or walls on the respective sides of the railroad car retarder. In previous types of noise barriers, the use of porous noise absorption material was unacceptable in that they soon become relatively ineffective in suppressing the noise produced by the car retarder. The principal reason for the loss in sound attenuation resides in the fact that the porous material readily becomes clogged with foreign matter, such as, dirt, oil, grease, water, ice and the like, which is common in a classification yard environment. In addition, low density types of noise absorption materials are generally susceptible to rapid deterioration due to the adverse physical and climatic conditions which are present in railroad yard milieu. Further, it will be appreciated that the maximum theoretical value of noise reduction or attenuation provided by a barrier structure is approximately 25 db which in many cases is insufficient to conform with the noise abatement ordinances in the particular locale and the safety standards set forth in the Occupational Safety Hazard Act of 1970. In present classification yards and in future proposed yard locations, it has been found that even at substantial distances, 5,000 feet or more, the noise level that permeates the area beyond the boundry line of the yard is in excess of the maximum permissible amplitude set forth in many of the local noise abatement ordinances. Thus, there is a vital need for providing an efficient noise reduction arrangement for effectively reducing or eliminating wheel squealing or screeching sounds produced by railroad car retarders. In addition, wheel squealing noises are produced at other locations in the trackway, such as, at curves or at tight gauge track sections where abrasive or rubbing action takes place between the wheels and the running rails. Hence, it is highly advantageous to provide an effective noise suppression arrangement for mitigating wheel screeching noises on curved track sections and at tight gauge locations.

OBJECTS AND SUMMARY OF THE INVENTION

Accordingly, it is an object of this invention to provide a novel car wheel noise abating arrangement for reducing or eliminating wheel squealing sounds.

Another object of this invention is to provide a unique noise reduction arrangement for absorbing vibrational energy imparted to the wheels of a railway vehicle by a car retarder.

A further object of this invention is to provide a vibrational energy absorbing rail arrangement for railway braking apparatus for suppressing wheel screeching noises in classification yards.

Yet another object of this invention is to provide a car wheel squealing noise reduction arrangement employing a running rail including vibrational dampening material.

Yet a further object of this invention is to provide a new and improved arrangement for dissipating sound producing energy in the running rails of a track section for mitigating wheel squealing noises.

Still another object of this invention is to provide a novel vibrational energy absorbing rail for a squeeze type of railroad car retarder for subduing wheel screeching sounds.

Still a further object of this invention is to provide in combination a railroad car retarder having a plurality of operating units disposed along the length of a running rail of the trackway, an elongated braking bar disposed on each side of the running rail and carried by the plurality of operating units, the elongated braking bar including a brake beam and a brake shoe for engaging the wheels of railway vehicles, characterized by the running rail including vibrational dampening material for absorbing vibrational energy from the passing wheels of the railway vehicles for preventing the development of wheel squealing noises.

An additional object of this invention is to provide in combination a section of railway trackway having a pair of running rails for guiding and supporting the wheels of passing railway vehicles, characterized by the running rails having vibrational dampening material for absorbing vibrational energy from the passing wheels of the railway vehicles for preventing the production of wheel squealing noises.

Yet an additional object of this invention is to provide a unique wheel squealing inhibiting arrangement for gripping types of car retarders, curved track sections or tight gauge locations which is economical in cost, simple in construction, easy to install and reliable in operation.

In the attainment of the foregoing objects there is provided a squeeze type of railroad car retarder having a plurality of operating units located along the length of the running rail of a section of track in a classification yard. Each of the operating units includes a fluid pressure motor and a pair of pivotal levers. Each of the pivotal levers carries an elongated braking bar which includes a brake beam and brake shoe movable to a braking position for engaging the sides of the wheels of railway vehicles traversing the car retarder. The running rail which extends substantially the length of the car retarder includes vibrational dampening material for absorbing vibrational energy from the passing wheels of the railway vehicle for preventing the development of wheels squealing or screeching noises.

In one embodiment, the running rail is formed of alternate sections of rubber and standard steel rails extending the substantial length of the car retarder. The rubber rail sections are strengthened by reinforcing tie bars which are disposed on each side of the web portion. The reinforcing tie bars span the length of the rubber rail section and the respective end of the bars are bolted to the adjoining steel rails to form a continuous rigid running rail throughout the length of the car retarder.

In an alternative embodiment, the running rail is formed of a rubber rail which extends substantially the length of the car retarder. The rubber rail section is strengthened by reinforcing tie bars which are disposed on each side of the rubber rail and which are tied together by bolts and nuts. The respective ends of the reinforcing tie bars are bolted to the ends of standard steel rails leading to and from the car retarder to form a rigid running rail.

Other objects, features and advantages of this invention will become more apparent from the following description of the preferred embodiments described with reference to the accompanying drawings forming a part of this specification, in which.

Figure 1:
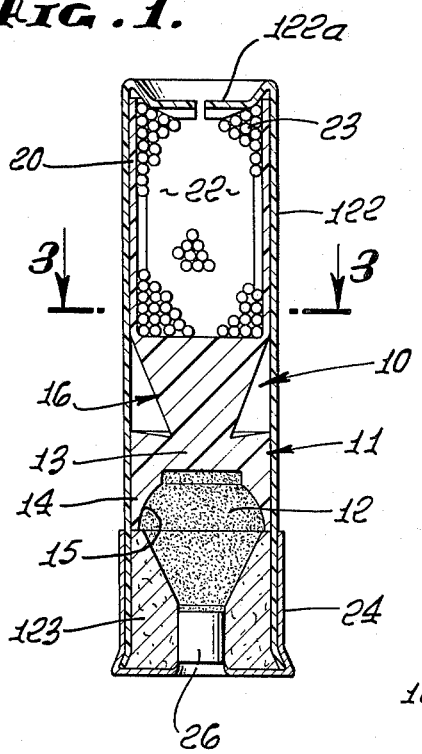
FIG. 1 is a fragmentary top plan view of a track section in, for example, a hump type of railroad freight car classification yard, utilizing a squeeze or gripping type of car retarder for controlling the speeds of moving railway vehicles and including one form of a vibrational absorbing running rail arrangement for reducing the production of wheel squealing noises.
Figure 2:
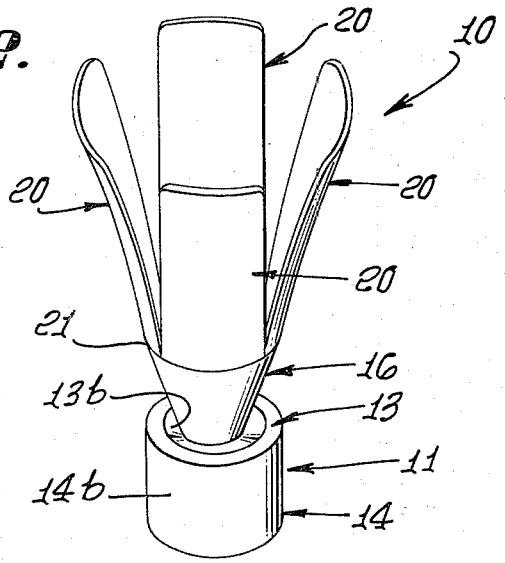
FIG. 2 is an enlarged sectional view taken along the lines II—II of FIG. 1.

Referring now to the drawings and in particular to FIGS. 1 and 2 there is shown a railroad car retarder generally characterized by numeral 1. In hump or gravity types of classification yards, it is desirable to sort and classify the freight cars or vehicles of an incoming train into other trains in accordance with their contents and/or their next destination. The railway cars of the incoming trains are pushed over a hump or incline so that the force of gravity moves the cars to the appropriate location in the selected class track. However, various parameters, such as, car weight, rolling resistance, wind velocity and the like, cause each of the free rolling cars to travel down the trackway at a different speed. In order to control the speed of the moving cars in accordance with their rollability and the distance-to-go, it is common practice to provide suitable braking apparatus at the hump and group track locations in the classification yard. Generally, the braking apparatus takes the form of the squeeze or gripping type of car retarder which has braking bars that are movable into and out of engagement with the wheels of passing railway cars for controlling the speed thereof. In group and hump applications, it is common practice to employ a dual track car retarder in order to ensure that sufficient braking effort is exerted on the wheels of the cars as they pass through the retarder.

As shown in FIG. 1, the dual track car retarder 1 includes a plurality of suitable operating units OU appropriately disposed along each rail of a section of trackway. Each of the operating units OU is substantially identical, and accordingly, a description of one will suffice for all of the operating units. As best shown in FIG. 2, a typical operating unit OU consists of an upper lever 3 and a lower lever 4. The levers 3 and 4 are operated by a fluid actuated motor M which causes pivotal movement about the common fulcrum point or pin 5. It will be seen that the free end of the upper pivotal lever 3 is also pivotally connected to the pneumatic cylinder member 6 of motor M while the free end of the lower pivotal lever 4 is also pivotally connected to the reciprocating piston member 7 of motor M. It will be noted that the upper lever 3 carries an elongated outer braking bar 8 while the lower lever 4 carries an elongated inner braking bar 9. As shown in FIG. 1, the braking bars 8 and 9 extend parallel to the track rails and are adapted to be moved relative to the track rails into braking and nonbraking positions. The braking bars 8 include brake beams 10 which are bolted to the upper surface of levers 3 while the braking bars 9 include brake beams 11 which are bolted to the upper surface of levers 4. The braking bars 8 include the elongated outer replaceable brake shoes 12 which are bolted to the brake beams 10, and the braking bars 9 include the elongated inner replaceable brake shoes 13 which are bolted to the brake beams 9. Thus, the pivotal movement of the levers 3 and 4 about the common fulcrum point 5 causes the braking bars 8 and 9 to move toward and away from each other as the fluid motors M are energized and deenergized via conduits 14 and 15 which are connected to a suitable source of fluid pressure (not shown). Hence, upon application of fluid pressure via conduits 14 and 15 to fluid actuating motors M, the braking bars 8 and 9 undergo an elevating and closing movement so that the brake shoes 12 and 13 frictionally engage the sides of wheel W of a traversing railway vehicle, as shown in FIG. 2. Conversely, upon the venting of the air from the actuating motors M to atmosphere via conduits 14 and 15, the force of gravity with the assistance of return springs S operating on levers 3 and 4 acts to lower and open the braking bars 8 and 9 to their normal nonbraking position. Accordingly, when a railway car or cut of cars moves through the retarder, the closing and opening of the braking bars allows for the speed of the traversing car or cars to be controlled in accordance with its ultimate destination in a class track.

A common occurrence in conventional squeeze or grip types of railroad car retarders is the production or development of large amplitude vibrations in the vehicle wheels and braking bars when the retarder remains closed for a given period of time. These vibrations imparted to the wheels, if allowed to build up, will result in a very loud and high pitched squealing or screeching noise to be produced by the retarder. That is, the stick-slip mechanism or the rubbing-grating action which takes place between the surfaces of the brake shoes and the sides of the vehicle wheels produces sufficient sound generating energy over a period of time to cause wheel squeal. Thus, the sound producing energy should be prevented from building up to the point where the retarder is capable of developing wheel screeching sounds. In order to abate this noise problem, it has been found to be desirous and advantageous to dampen out the sound producing energy by employing a vibration absorbing arrangement in combination with the railroad car retarder. The noise reduction or elimination is accomplished by constructing the running rail within the confines of the retarder of an appropriate sound absorbing material. It will be appreciated that the entrance rail sections 20*a* and 20*b*, namely, the left-hand rails, as viewed in FIG. 1 of the drawings, are standard steel rails, such as, 90 lb. rails. It will be noted that steel rails 20*a* and 20*b* normally extend beyond the first pair of operating units OU and terminates just before the location of a second pair of operating units OU. The next rail sections 22*a* and 22*b* are constructed of suitable vibrational dampening or absorbing material, such as rubber or any other suitable elastomer. As shown in FIG. 2, the rubber running rail 22*a* has a cross sectional configuration substantially identical to that of the standard steel rail. Further, it will be noted that the rubber rail 22*a* is fitted with a pair of reinforcing bars 21*a* and 21*b*. The reinforcing bars 21*a* and 21*b* are positioned on each side of the running rubber rail 22*a* and are contiguous with the web portion, the under sides of the head and the upper sides of the base of the rail. The reinforcing bars span the length of the rubber rail and extend beyond both ends so that they may be secured to entrance steel rail 20*a* and the next running steel rail 24*a* by nuts and bolts 25*a* and 25*b*. Thus, the reinforcing bars 21*a* and 21*b* strengthen the rubber rail 22*a* and are securely tied to the adjacent steel rails 20*a* and 24*a*. It will be seen that the elastomer rail section 22*b* is strengthened by a pair of reinforcing steel bars 23*a* and 23*b* which are bolted to the steel rail 20*b* and 24*b*, respectively. The steel running rails 24*a* and 24*b* have vibrational absorbing rubber rails 26*a* and 26*b* in abutment with their other ends. The rubber rail section 26*a* is strengthened by reinforcing tie bars 27*a* and 27*b* which are bolted to the steel rail 24*a* and to the next contiguous steel rail 28*a*. Similarly, the rubber rail section 26*b* is strengthened by reinforcing tie plates 29*a* and 29*b* which are bolted to the steel rail 24*b* and the next contiguous steel rail 28*b*. The alternate disposition of the steel and rubber running rails continues through the entire length of the car retarder 1. The remaining sections of the upper running rail are made up of steel rail 30*a*, rubber rail 32*a*, steel rail 34*a*, rubber rail 36*a*, steel rail 38*a*, and rubber rail 40*a* which is contiguous exiting steel running rail 42*a*. The rubber rails 32*a*, 36*a* and 40*a* are reinforced by tie bars 31*a*–31*b*, 33*a*–33*b* and 35*a*–35*b* which are bolted to the steel rails 30*a*, 34*a*, 38*a* and 42*a*, respectively. Likewise, the remaining sections of the lower running rail are made up of steel rail 30*b*, rubber rail 32*b*, steel rail 34*b*, rubber rail 36*b*, steel rail 38*b*, rubber rail 40*b* and exit steel rail 42*b*. The rubber running rail sections 32*b*, 36*b* and 40*b* are reinforced by steel tie bars 37*a*–37*b*, 39*a*–39*b* and 41*a*–41*b* which are bolted to the steel running rails 30*b*, 34*b*, 38*b* and 42*b*, respectively. Thus, each of the elongated upper and lower running rails of the railroad car retarder is formed by a plurality of alternate lengths of steel and rubber rail sections which are tied together by the reinforcing bars to make up an integral structure.

As previously mentioned, if the car retarder remains closed for a given period of time when a railway vehicle is moving through it, the brake shoes will cause the wheels to begin vibrating due to the slip-slide braking action. In previous retards, this imparted vibrational energy of the wheels resulted in the generation of very high pitch squealing or screeching sounds. In the present instance, it will be appreciated that as wheels enter the car retarder and progress along steel rails 20*a* and 20*b*, vibrational energy will begin to build up in the wheels of the humped car. However, before the amplitude of the vibrational forces are sufficient to cause wheel squealing noises, the treads of the wheels will contact the top of rubber rails 22*a* and 22*b*. The rubber rails provide an energy dampening effect on the passing wheels so that the vibrational forces are absorbed and dissipated by the mechanism friction and viscosity of the elastomeric material. Thus, energy is removed from the wheels of the passing cars by the first elastomer rails 22*a* and 22*b* so that the vibrations are subdued and no wheel squealing noises are produced by the car retarder. The dampening effect continues through the length of the sound energy absorbing rails 20*a* and 20*b*, and then the wheels of the moving vehicle pass onto the steel rails 24*a* and 24*b*. As the wheels pass over steel rails 24*a* and 24*b*, vibrational energy is again imparted to the vehicle wheels due to their engagement with the steel running rail 24*a* and 24*b* and the brake shoes 12 and 13. The lengths of the steel rails 24*a* and 24*b* are chosen to be less than that required to have the vibrational force built up to the point where wheel squealing will occur. Thus, the wheels will contact the vibrational dampening rails 26*a* and 26*b* before any wheel screeching noises occur so that the impressed vibrational forces are again absorbed and dissipated by the elastomeric material. The wheels of the moving vehicle next pass onto steel rails 28*a* and 28*b*. Thus, the wheels of the vehicle alternately travel over the steel and rubber rail sections until the vehicle exists onto the steel rails 42*a* and 42*b* located at the end of the car retarder. Thus, the vibrational forces are repeatedly absorbed and dissipated by the alternately disposed rubber rails of the two running rails which extend the length of the car retarder so that wheel squealing sounds are prevented from being produced by the abrasive action which takes place between the brake shoes and the wheels of the passing vehicles in the arrangement shown in FIGS. 1 and 2.

Figure 3:
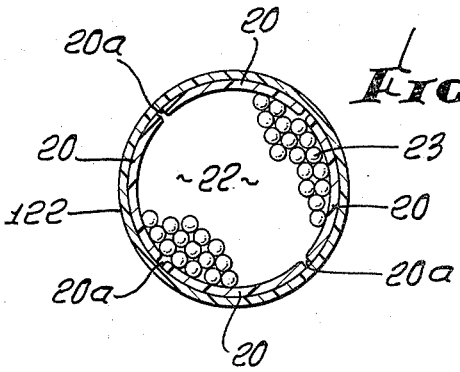
FIG. 3 is a partial fragmentary top plan view of another form of vibrational absorbing running rail for a wheel gripping type of railway braking apparatus.
Figure 4:
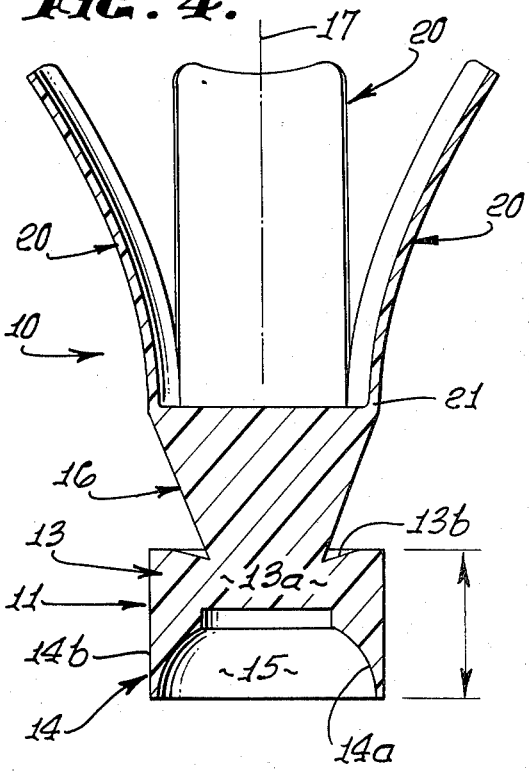
Figure 5:
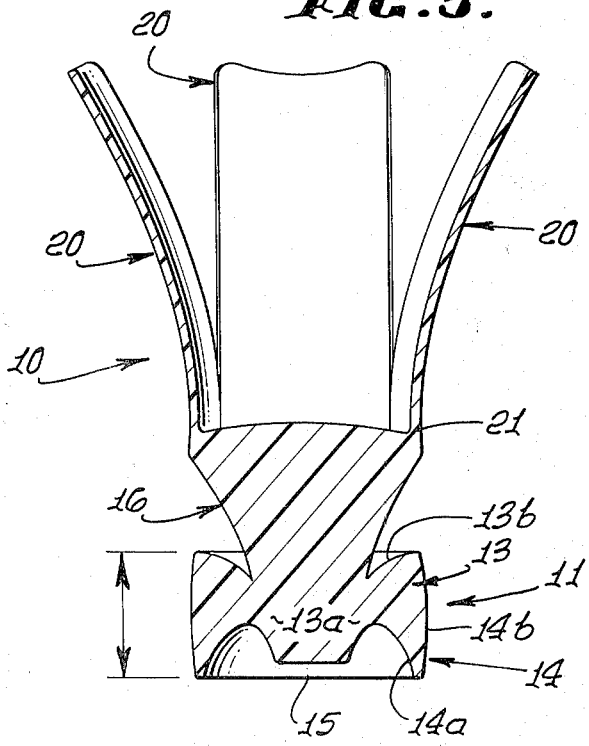
Figure 1:
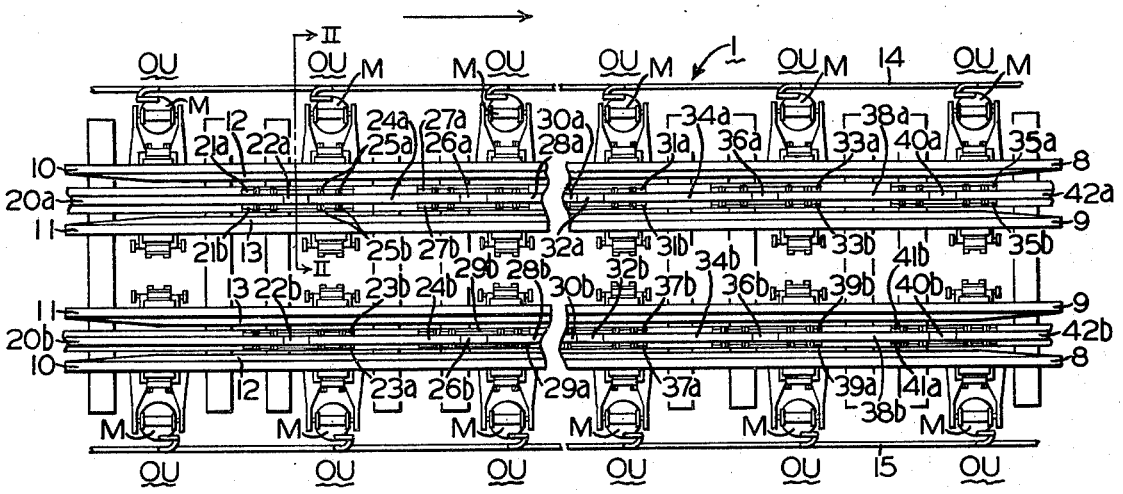
Figure 2:
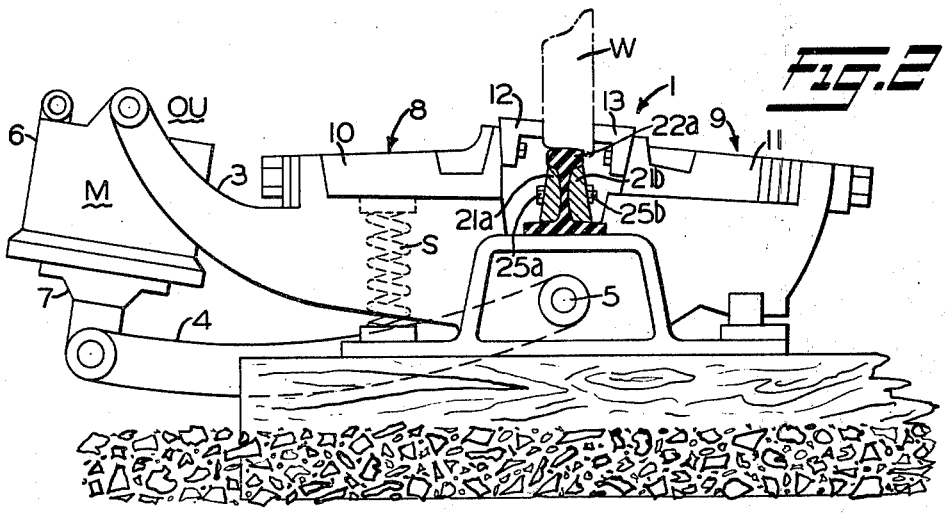
Figure 3:
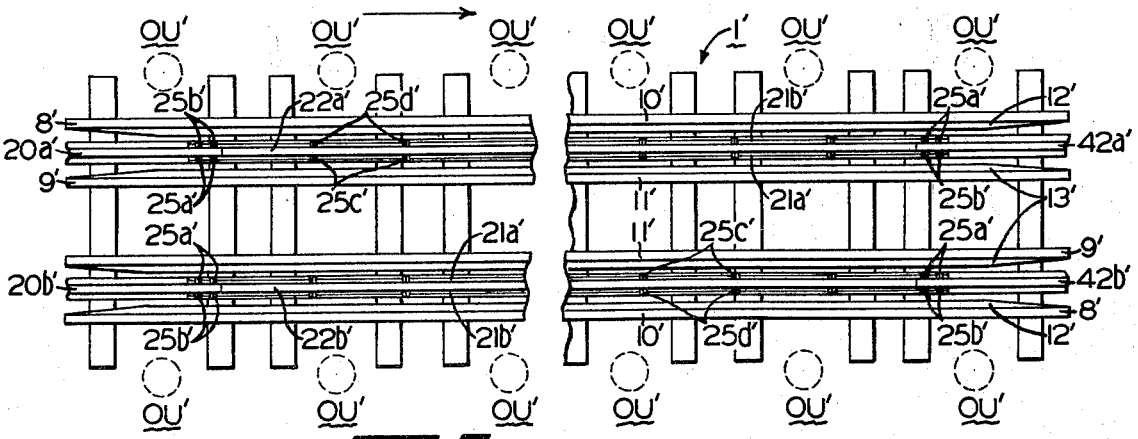

Turning now to FIG. 3, there is shown an alternate arrangement for effectively alleviating the noise pollution which normally occurs in a railroad car retarder in classification yards. In viewing FIG. 3, it will be noted that the details of the operating units have been dispensed with and their location is simply replaced by the phantom circles OU for the purpose of convenience. Each of the operating units OU includes the same structure as described in detail in FIGS. 1 and 2, and each operating unit functions in the same manner as described above. That is, the upper and lower pivotal levers carry elongated brake bars 8' and 9', respectively. As previously mentioned, the braking bars extend parallel to the track rails and are adapted to be manipulated relative to the rails into either a braking position or a nonbraking position. The outer braking bars 8' include brake beams 10' which are securely fastened to the upper levers of the operating units OU' while the inner braking bars 9' include brake beams 11' which are securely fastened to the lower levers of the operating units OU'. The braking bars 8' also include replaceable brake shoes 12' which are suitably secured to the brake beams 10'. Similarly, the braking bars 9' also include replaceable brake shoes 13' which are suitably secured to the brake beams 11'. Hence, the pivotal movement of the upper and lower levers of the operating units OU' causes the braking bars 8' and 9' to move toward and away from each other to assume a braking and nonbraking position, respectively. In viewing FIG. 3, it will be noted that the left-hand or entrance rail sections 20*a'* and 20*b'* are standard steel rails. Again, it will be noted that the entrance rails extend slightly beyond the first set of operating units OU' and are in abutting relationship with the ends of elastomeric running rails 22*a'* and 22*b'*. In the present instance, it will be observed that the rubber running rails 22*a'* and 22*b'* run substantially the entire length of the car retarder 1' and in fact terminate a short distance before the last pair of operating units OU'. As shown, the exit end of the car retarder is provided with standard steel rails 42*a'* and 42*b'* which abut with the terminal ends of rubber rails 22*a'* and 22*b'*. In order to increase the supporting strength of the rubber rails 22*a'* and 22*b'*, it is desirable to reinforce the sides of the rails 22*a'* and 22*b'* with elongated steel bars. As shown, the rubber rail 22*a'* is strengthened by reinforcing bars 21*a'* and 21*b'* which are disposed on the respective sides of rail 22*a'* and are in contact with the web, the under sides of the head and the upper sides of the base of the rail. The reinforcing bars span the length of the rubber rail 21*a'* and extend beyond both ends of the rail 21*a'*. It will be seen that the respective ends of the reinforcing bars are securely fastened to the entrance and exit rails by bolts and nuts 25*a'* and 25*b'*. In addition, it will be noted that the reinforcing bars 21*a'* and 21*b'* are tied to the rubber running rail 22*a'* by bolts 25*c* and nuts 25*d* to provide rigidity throughout the length of the running rail. Similarly, the rubber running rail 22*b* is provided with steel reinforcing bars 21*a'* and 21*b* ' which have their ends securely fastened to the ends of the entrance and exit rails 20*b'* and 42*b'* by bolts and nuts 25*a'* and 25*b'*, respectively. Likewise, a plurality of bolts and nuts 25*c'* and 25*d'* are suitably located along the length of the rubber running rail 22*b'* to tie the reinforcing bars together and to strengthen the intermediate portions of rubber running rail 22*b*. In the present instance, it will be observed that the car retarder may remain closed for the entire time that is required for the traversing railway car to pass through the car retarder. It will be appreciated that the vibrational energy imparted to the wheels of the car or cars is constantly dampened by the rubber running rails 22*a'* and 22*b'* so that the energy level necessary to produce wheel squealing noises is unattainable in the present car retarder arrangement. That is, the vibrations transmitted to the wheels are continually absorbed and dissipated by the resilient running rails 22*a'* and 22*b'* so that excessive energy is prevented from building up in the wheels. Thus, wheel screeching sounds due to the abrasive-rubbing action of the brake shoes on the wheels of the railway car are effectively reduced and eliminated by the sound absorbing material of the running rail.

Accordingly, the running rail dampening arrangements of the present invention efficiently and effectively reduce the production of irritating and injurious noises which would normally be generated by car retarders in railroad classification yards as well as on curved track sections or at tight gauge locations where wheel squealing noises occur due to the rubbing or abrasive action between the wheels and the steel running rails.

It will be appreciated that various changes, alterations and modifications may be made in the construction of the presently described arrangements without departing from the spirit and scope of the subject invention. Therefore, it is intended that all the subject matter contained in the foregoing description and shown in the accompanying drawings should be interpreted as illustrative and not in a limiting sense.

Having now described the invention what I claim as new and desire to secure by Letters Patent, is:

1. In combination, a railroad car retarder having a plurality of operating units disposed along the length of a running rail of a trackway, an elongated braking bar disposed on each side of said running rail and carried by said plurality of said operating units, said elongated braking bar including a brake beam and a brake shoe for engaging the wheels of railway vehicles, characterized by said running rail including alternate substantial lengths of metal and vibrational dampening material for contacting the passing wheels of the railway vehicles, said vibrational dampening material for absorbing sound producing energy from the passing wheels of the railway vehicles for preventing the development of wheel squealing noises, and means for reinforcing said vibrational dampening material to form a substantially rigid running rail.

2. The combination as defined in claim 1, wherein said vibrational dampening material is rubber.

3. The combination as defined in claim 1, wherein said vibrational dampening material is an elastomer.

4. The combination as defined in claim 1, wherein said running rail of said vibrational dampening material extends the length of the car retarder.

5. The combination as defined in claim 4, wherein said reinforcing means takes the form of metal bars which are disposed on each side of said running rail for strengthening said running rail.

6. The combination as defined in claim 1, wherein said running rail includes lengths of rail formed of steel along with adjacent lengths of rail formed from said vibrational dampening material.

7. The combination as defined in claim 6, wherein said lengths of rail formed of said vibrational dampening material are strengthened by said reinforcing means which take the form of metal bars.

8. The combination as defined in claim 1, wherein said running rail is formed of alternate lengths of rubber rail and steel rail.

9. The combination as defined in claim 1, wherein said running rail is formed of alternate lengths of elastomer rail and steel rail.

10. The combination as defined in claim 9, wherein said reinforcing means takes the form of metal plates which are disposed on each side of said running rail and span the length of the elastomer and which are securely fastened to the adjacent steel rails.

11. In combination, a section of railway trackway having a pair of running rails guiding and supporting the wheels of passing railway vehicles, characterized by said running rails having alternate substantial lengths of metal and vibrational dampening material for contacting the passing wheels of the railway vehicles, said vibrational dampening material for absorbing sound producing energy from the passing wheels of the railway vehicles for preventing the production of wheel squealing noises, and means for reinforcing said vibrational dampening material to form substantially rigid running rails.

* * * * *